US010059580B2

(12) United States Patent
Wyatt et al.

(10) Patent No.: US 10,059,580 B2
(45) Date of Patent: Aug. 28, 2018

(54) MODULAR BEVERAGE COOLING SYSTEM

(71) Applicant: Manitowoc Foodservice Companies, LLC, Manitowoc, WI (US)

(72) Inventors: Gary David Wyatt, Worcestershire (GB); Nigel Mobbs, Worcester (GB)

(73) Assignee: MANITOWOC FOODSERVICE COMPANIES, LLC, New Port Richey, FL (US)

( * ) Notice: Subject to any disclaimer, the term of this patent is extended or adjusted under 35 U.S.C. 154(b) by 0 days.

(21) Appl. No.: 15/308,799

(22) PCT Filed: May 6, 2014

(86) PCT No.: PCT/US2014/036987
§ 371 (c)(1),
(2) Date: Nov. 3, 2016

(87) PCT Pub. No.: WO2015/171121
PCT Pub. Date: Nov. 12, 2015

(65) Prior Publication Data
US 2017/0183210 A1 Jun. 29, 2017

(51) Int. Cl.
*B67D 1/08* (2006.01)
*F25D 31/00* (2006.01)

(52) U.S. Cl.
CPC ..... *B67D 1/0864* (2013.01); *B67D 1/0888* (2013.01); *F25D 31/002* (2013.01); (Continued)

(58) Field of Classification Search
CPC ..... B67D 1/0864; B67D 1/0888; B67D 2210/00104; B67D 2210/00034; (Continued)

(56) References Cited

U.S. PATENT DOCUMENTS 4,517,807 A * 5/1985 Harnish ..... F24D 17/02 165/241
4,800,729 A * 1/1989 Hara ..... F25B 25/005 62/185

(Continued)

FOREIGN PATENT DOCUMENTS

EP 1862427 A1 12/2007
GB 2480861 A 12/2011

(Continued)

OTHER PUBLICATIONS

International Search Report dated Sep. 24, 2014 for PCT application No. PCT/US2014/036987.

(Continued)

*Primary Examiner* — Emmanuel Duke
(74) *Attorney, Agent, or Firm* — Ohlandt, Greeley, Ruggiero & Perle, LLP

(57) ABSTRACT

A beverage cooling system includes a main assembly having a refrigeration module, a pumping and control module, and a beverage cooling module. The refrigeration module has a refrigeration system cooling a cooling medium. The beverage cooling module has a cooling tank cooled by the refrigeration system. The pumping and control module has a pump to pump a beverage ingredient cooled by the refrigeration system. Each of the refrigeration module, the pumping and control module, and beverage cooling module are independently removable from and connectable to the remainder of the main assembly.

18 Claims, 15 Drawing Sheets

(52) U.S. Cl.
CPC ..... *B67D 2210/00034* (2013.01); *B67D 2210/00104* (2013.01); *F25D 2400/16* (2013.01); *F25D 2400/361* (2013.01); *F25D 2400/38* (2013.01)

(58) Field of Classification Search
CPC ... B67D 1/08; F25D 31/002; F25D 2400/361; F25D 2400/16; F25D 2400/38
See application file for complete search history.

(56) References Cited

U.S. PATENT DOCUMENTS

| | | | | |
|---|---|---|---|---|
| 5,970,732 | A * | 10/1999 | Menin | B67D 1/0861 62/101 |
| 6,438,989 | B1 * | 8/2002 | Wolski | B67D 1/0864 62/299 |
| 2003/0056939 | A1 | 3/2003 | Chu et al. | |
| 2003/0056969 | A1 | 5/2003 | Eves et al. | |
| 2007/0158250 | A1 * | 7/2007 | Dickinson | B01D 29/27 210/184 |
| 2010/0318221 | A1 * | 12/2010 | Wiemer | B67D 1/0021 700/240 |
| 2011/0308260 | A1 * | 12/2011 | Johansson | F25D 23/126 62/66 |
| 2012/0067076 | A1 | 3/2012 | Schroeder et al. | |
| 2013/0276469 | A1 * | 10/2013 | Dryzun | A23L 3/36 62/186 |
| 2013/0277394 | A1 | 10/2013 | Edwards | |

FOREIGN PATENT DOCUMENTS

| | | | |
|---|---|---|---|
| WO | 2001014243 | A1 | 3/2001 |
| WO | 2007029074 | A1 | 3/2007 |

OTHER PUBLICATIONS

Written Opinion dated Sep. 24, 2014 for PCT application No. PCT/US2014/036987.
International Preliminary Report on Patentability (IPRP) dated Jul. 29, 2016 for PCT application No. PCT/US2014/036987.
International Preliminary Report on Patentability (IPRP) dated Apr. 29, 2016 for PCT application No. PCT/US2014/036987.
European Search Report dated Jan. 31, 2018 for European application No. 14891281.9.

* cited by examiner

SET LANGUAGE SCREEN

SET OUTPUTS SCREEN

TEMPERATURE DISPLAY SCREEN

FIG. 15

STATUS PAGES 1, 2 & 3

STATUS PAGE 1
Cent. pump A1 OFF
Reciprc A1 OFF
Compressor A1 OFF

STATUS PAGE 2
Applicator 1 OFF
Boost Sol. 1 OFF
Flood Sol. 1 OFF

STATUS PAGE 3
Cent. pump B1 OFF
Reciprc B1 OFF
Compressor B1 OFF

CHANGE PARAMETERS SCREEN

ENTER PASSWORD SCREEN

HOME PAGE (showing Example of Fault)

MODULAR BEVERAGE COOLING SYSTEM

BACKGROUND OF THE DISCLOSURE

1. Field of the Disclosure

This disclosure relates to beverage cooling systems. More particularly, this disclosure relates to a modular beverage cooling system having modules that are independently removable from and connectable to the remainder of the main assembly.

2. Description of Related Art

A conventional beverage cooler contains all the major refrigeration components, such as compressor and evaporator, integrally within a single cooler carcass. The refrigeration system is configured so that the evaporator is contained in a waterbath and the other refrigeration components are situated in an area commonly referred to as the "fridge compartment". The evaporator is hermetically connected to the other refrigeration components most commonly by rigid copper or stainless steel pipework, via permanent or semi-permanent soldered or brazed joints. Therefore, the fridge compartment and waterbath are essentially inseparable in service, other than by a service person skilled and trained in the art of refrigeration, and having all the necessary specialist equipment to safely carry out the operation. In almost all instances, in the event of a failure in the refrigeration system, such as a micro-leak of refrigerant, or a compressor failure, the entire beverage cooler must be disconnected from the installation, and replaced. In many instances, this may be a major and expensive operation, requiring at least two service engineers and a complete replacement beverage cooler.

Further with a conventional beverage cooler, the cooling capacity is determined by the size, or displacement of the compressor. It is not possible to increase the cooling capacity of an installed beverage cooler. So, if a conventional cooler is correctly sized to suit a trading account at the time of installation, it may not have sufficient capacity to accommodate a significant increase in drinks sales in a future changing market. It does not make financial sense, both from an acquisition cost or energy consumption perspective, to install over-sized coolers where sales do not warrant it at the time of installation. Likewise, a long-term downturn in sales could leave an end user with a cooler that is over-sized for the prevailing market, incurring higher than necessary energy costs and wasted capacity. The preferred solution in both circumstances may be to replace the existing cooler with an alternative cooler more appropriately sized for the new trading environment. This is a costly and disruptive operation, usually requiring two service operatives and significant downtime.

Moreover, conventional beverage coolers are designed and constructed with a specific refrigerant type included. The refrigerant type may be a customer preference, or may be dictated by environmental regulations. Once constructed and commissioned, it is unlikely that a change of refrigerant would be feasible during an individual cooler's operational lifetime. So, any change in a customer's preference, or further environmental legislation against an existing refrigerant, or even a new refrigerant entering the market with significant advantages over the current range of refrigerants could mean an entire population of beverage coolers might have to be replaced, simply to accommodate a change of refrigerant.

Additionally, the conventional beverage cooler is installed in a pre-determined space within the trading account. In many cases, this space may be unsuitable for a variety of reasons. For example, the conventional beverage cooler may be sited in a very restrictive area, where air circulation is poor; this may compromise the efficiency and performance of the conventional beverage cooler, and may result in premature component failure, high energy consumption, or repeated service calls for warm drinks. Alternatively, the conventional beverage cooler could be sited in an area where excessive heat or cold is experienced for large parts of the day; these extremes may also impact on performance, energy consumption and reliability. Little can be done to alleviate these conditions, once the conventional beverage cooler is installed and commissioned.

Further, when a conventional cooler has experienced a failure of the refrigeration system, the entire cooler must be removed from the trading account and returned to the original equipment manufacturer or an approved repair agent, irrespective of the fact that no other part of the dispense system is faulty. This leads to a situation where large coolers awaiting refrigeration repairs consume a disproportionate amount of factory space.

Accordingly, there is a need for a modular beverage cooler that has a refrigeration module, a pumping and control module, and a beverage cooling module that are independently removable from and connectable to the remainder of a main assembly. There is a further need for a modular beverage cooler that has a second cooling medium that is circulated in a cooling tank and that is cooled by a refrigeration system having a first cooling medium. There is still a further need for a modular beverage cooler that has a first refrigerant that flows into a condenser or gas cooler where the first refrigerant is cooled by a fan, and a second refrigerant that is cooled by the refrigeration system that is circulated by a pump where the pump and the fan are operated by the same motor.

SUMMARY OF THE DISCLOSURE

A beverage cooling system is provided that includes a main assembly having a refrigeration module, a pumping and control module, and a beverage cooling module. The refrigeration module has a refrigeration system cooling a cooling medium. The beverage cooling module has a cooling tank cooled by the refrigeration system. The pumping and control module has a pump to pump a beverage ingredient cooled by the refrigeration system. Each of the refrigeration module, the pumping and control module, and beverage cooling module are independently removable from and connectable to the remainder of the main assembly.

A beverage cooling system is also provided that includes a refrigeration module having a refrigeration system cooling a first cooling medium, and a beverage cooling module connected to the refrigeration module. The beverage cooling module has a cooling tank that cools at least one beverage ingredient. The beverage cooling module has a second cooling medium cooled by the refrigeration system that is circulated in the cooling tank.

A beverage cooling system is additionally provided that includes a refrigeration system cooling a first refrigerant. The first refrigerant flows into a condenser or gas cooler where the first refrigerant is cooled by a fan. A second refrigerant is cooled by the refrigeration system that is circulated by a pump in a cooling tank to cool at least one beverage ingredient. The pump and the fan are operated by the same motor.

The above-described and other features and advantages of the present disclosure will be appreciated and understood by those skilled in the art from the following detailed description, drawings, and appended claims.

BRIEF DESCRIPTION OF THE DRAWINGS

Other and further benefits, advantages and features of the present disclosure will be understood by reference to the following specification in conjunction with the accompanying drawings, in which like reference characters denote like elements of structure and:

FIG. 15 illustrates a front view of the liquid crystal display of the user interface of FIG. 11 showing status pages screens.

DETAILED DESCRIPTION OF THE PRESENT DISCLOSURE

Figure 1:
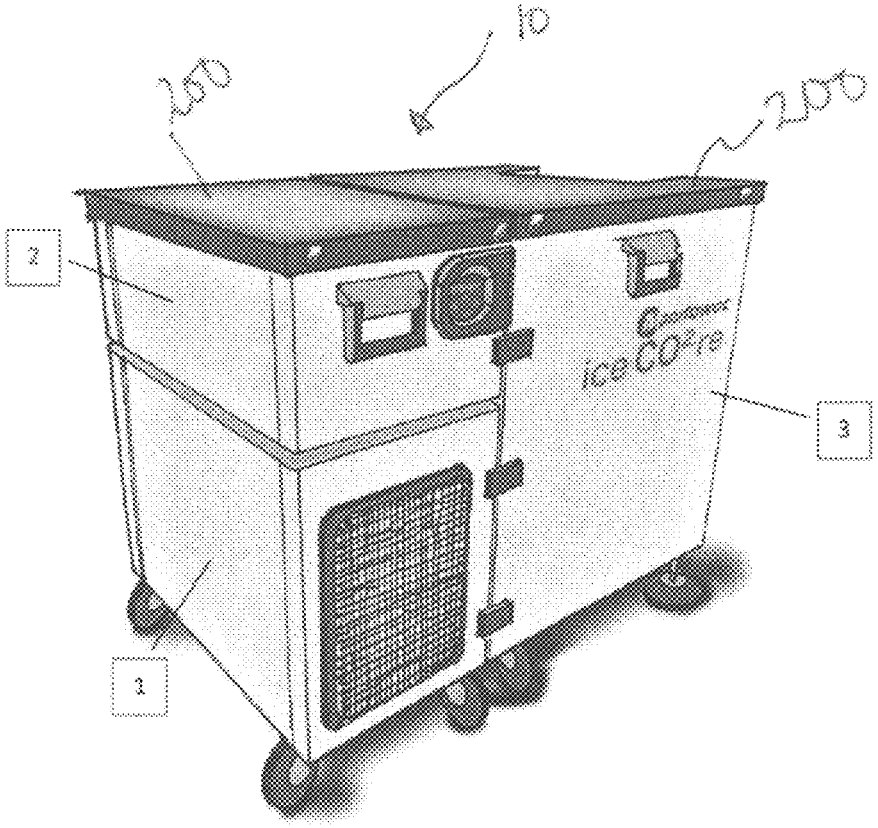
FIG. 1 illustrates a top, front, side perspective view of a beverage cooling system according to the present disclosure.

Referring to FIG. 1, a top, front, side perspective view of a beverage cooling system is shown, and generally referred to by reference numeral 10. Beverage cooling system 10 is a draught or draft beverage cooler. Beverage cooling system 10 includes a main assembly that includes a refrigeration module 1, a pumping and control module 2, and a beverage cooling module 3. Beverage cooling system 10 has a modular design, allowing refrigeration module 1, pumping and control module 2, and beverage cooling module 3 to be independently removable from and connectable to the remainder of the main assembly. The modular design, allows any or all of refrigeration module 1, pumping and control module 2, and beverage cooling module 3 to be exchanged, independently of the other of refrigeration module 1, pumping and control module 2, and beverage cooling module 3, in the field, by a single person not necessarily trained in the skills of refrigeration. Refrigeration module 1, pumping and control module 2, and beverage cooling module 3 are three self-contained modules, which connect together to form a complete beverage cooling system 10. Pumping and control module 2 and beverage cooling module 3 may each have a cover 200 that is removable, as shown in FIG. 7A. Pumping and control module 2 may be stacked on refrigeration module 1 to provide a cover for refrigeration module 1.

Figure 2:
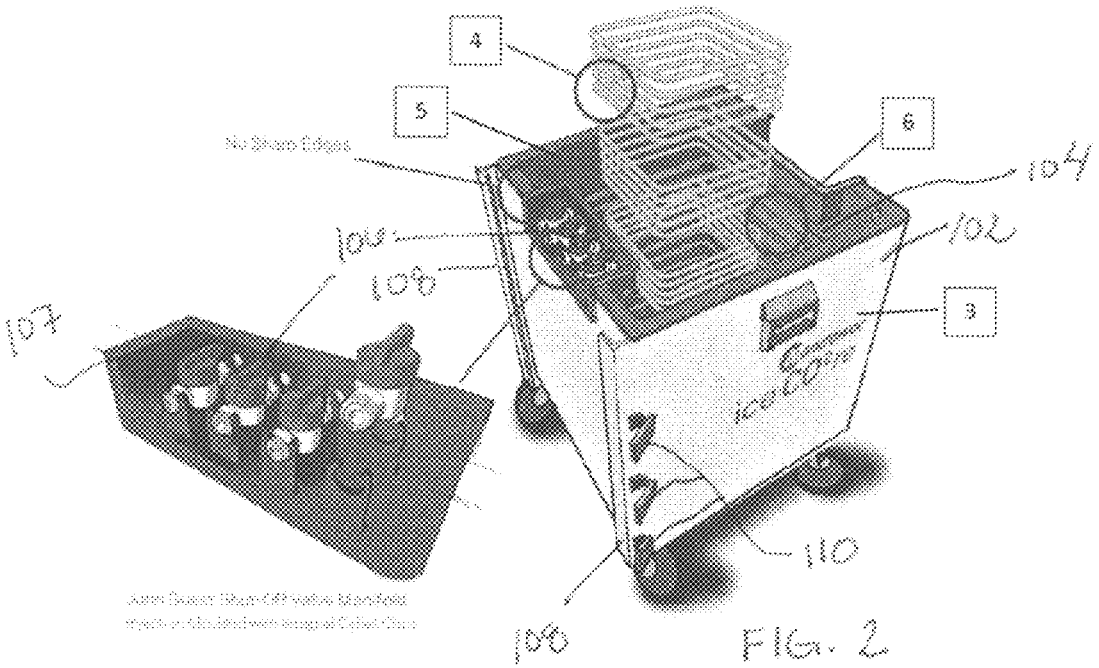
FIG. 2 illustrates a partially exploded top, front, side perspective view of a beverage cooling module of the beverage cooling system of FIG. 1.

Referring to FIG. 2, beverage cooling module 3 cools at least one beverage ingredient, which may include water and flavored syrup concentrates, supplied from an external source. Beverage cooling module 3 has a cooling housing 102. In cooling housing 102, the at least one beverage ingredient flows through a nest of cooling coils 4 immersed in a tank 5 filled with a cooling medium. The cooling medium may include water or a mix of water and ice that is cooled on demand via a heat exchanger coil 6 and stirred by an agitator (not shown). Heat exchanger coil 6 is connected to an interior wall 104 of tank 5. Tank 5 has valves 106 that connect a flow of the beverage ingredient with cooling coils 4. Valves 106 may be connected to a manifold 107 so that valves 106 are removable from manifold 107. Valves 106, for example, are positioned in a John Guest® shut-off valve manifold. Cooling to tank 5 is provided by the refrigeration module 1 by a flow of secondary cooling medium into heat exchanger coil 6. The secondary medium may consist of a solution of water and anti-freeze, such as propylene glycol, or any other medium suitable for the purpose. The secondary cooling medium may be Potassium Formate, a salt based glycol. It has been found by the present disclosure that Potassium Formate as the secondary cooling medium has enabled gain of some significant performance improvements. The exterior of beverage cooling module 3 could be manufactured from a number of materials including sheet steel, both stainless steel, plastic coated as well as painted mild steel. The exterior of beverage cooling module 3 may also be produced using a number of different methods in plastic. These could include vacuum forming, injection moulding or rotational moulding. Tank 5 may also be manufactured as per the above but excluding mild steel and any painted materials.

Cooling housing 102 has connection receptacles 108 and latches 110 for connection to and detachment from one or both of refrigeration module 1 and pumping and control module 2.

Figure 3:
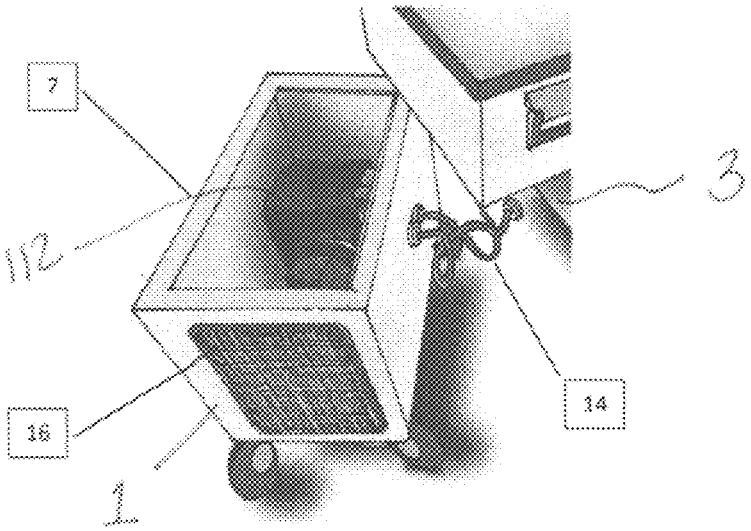
FIG. 3 illustrates a top, front, side perspective view of a refrigeration module of the beverage cooling system of FIG. 1.
Figure 4:
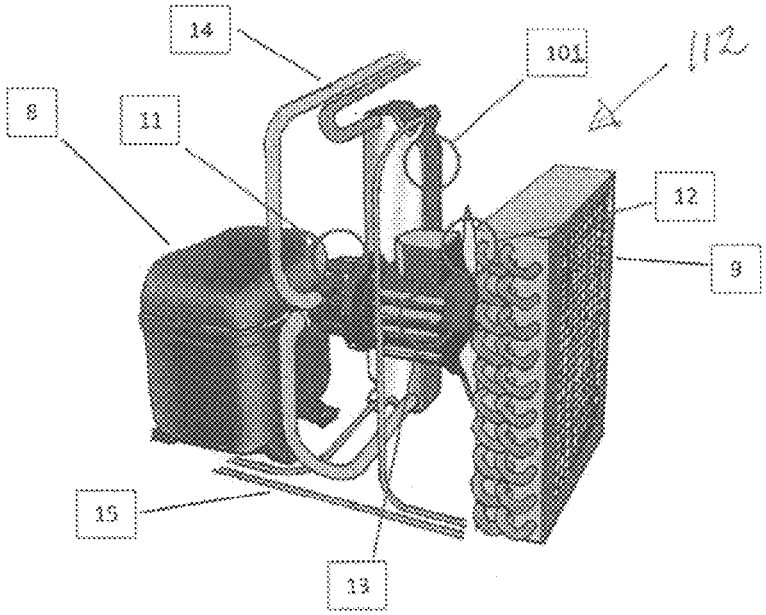
FIG. 4 illustrates a top, front, side perspective view of a refrigeration system of the refrigeration module of FIG. 3.

Referring to FIGS. 3 and 4, refrigeration module 1 has a refrigeration housing 16. Refrigeration module 1 is a self-contained assembly. Refrigeration module 1 has a refrigeration system 112. Refrigeration system 112 has a compressor 8, a condenser 9, an evaporator 101, a pump 11, a fan 12 that cools air, a dual spindle motor 13, coolant transfer tubing 14, and rigid copper refrigeration tubing 15, that are all housed in refrigeration housing 7. Pump 11 and fan 12 are mounted on dual spindle motor 13. Pump 11 may be a magnetically coupled coolant transfer pump. Coolant transfer tubing 14 is flexible tubing that connects evaporator 101 with heat exchanger coil 6. Alternatively, condenser 9 is a gas cooler. Evaporator 101 may alternatively be a heat exchanger. Refrigeration housing 7 has an opening 16 covered by a grate to allow heat exchange of refrigeration system 112 with the ambient environment.

Figure 5:
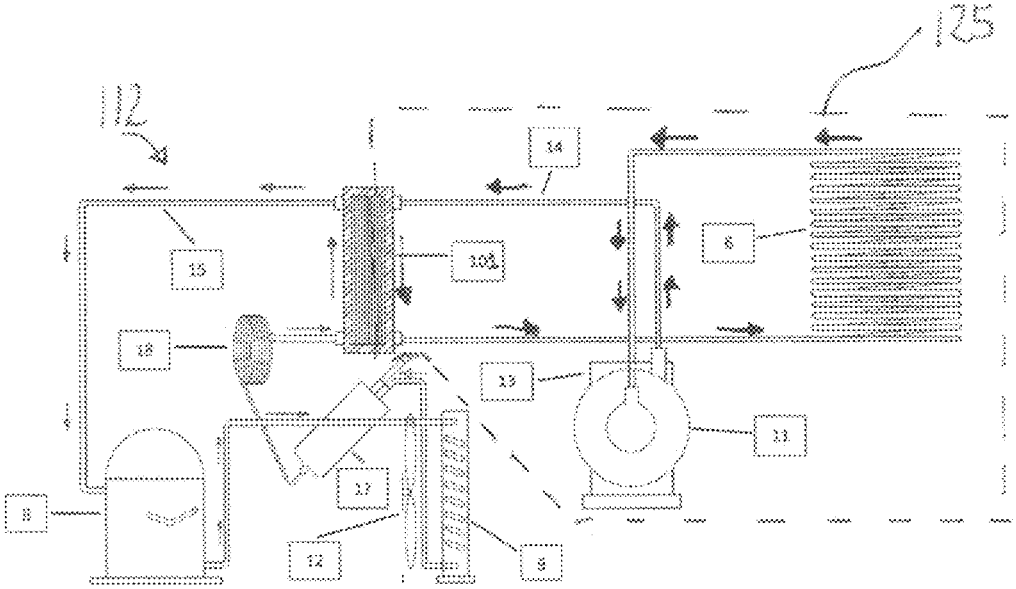
FIG. 5 is a schematic diagram of a first circulation path of a first cooling medium through the refrigeration system and a secondary system of a second cooling medium through a cooling loop of the beverage cooling system of FIG. 1.

Referring to FIG. 5, a schematic diagram illustrates a first circulation path of a first cooling medium through refrigeration system 112 and a second circulation path of a second cooling medium through a secondary system 125 of beverage cooling system 10. The first cooling medium in refrigeration system 112 is compressed into a high temperature and high pressure vapor in compressor 8. The first cooling medium flows into the condenser 9, where it is cooled by the action of fan 12, into a liquid. In the case of the first cooling medium being R744 (CO2) refrigerant, there is no phase change from vapor to liquid in the transcritical refrigeration cycle. The first cooling medium passes through a filter drier 17 and into an expansion device 18. Expansion device 18 is shown in FIG. 5 as copper capillary tubing. As the first cooling medium that is liquid exits expansion device 18 and enters a primary inlet side of evaporator 101 the first cooling medium expands and evaporates into a mixture of liquid and vapor, the liquid evaporating totally to become vapor as the first cooling medium reaches an outlet of evaporator 101. The first cooling medium that is the vapor returns to compressor 8 to be re-compressed in a continuous cycle. The first cooling medium is significantly chilled by the evaporative process of refrigeration system 112, typically to minus 10 degrees Celsius, and this chilling provides cooling energy for the liquid cooled side of refrigeration system 112. Single-phase secondary refrigerant could be used as the first cooling medium.

Figure 6:
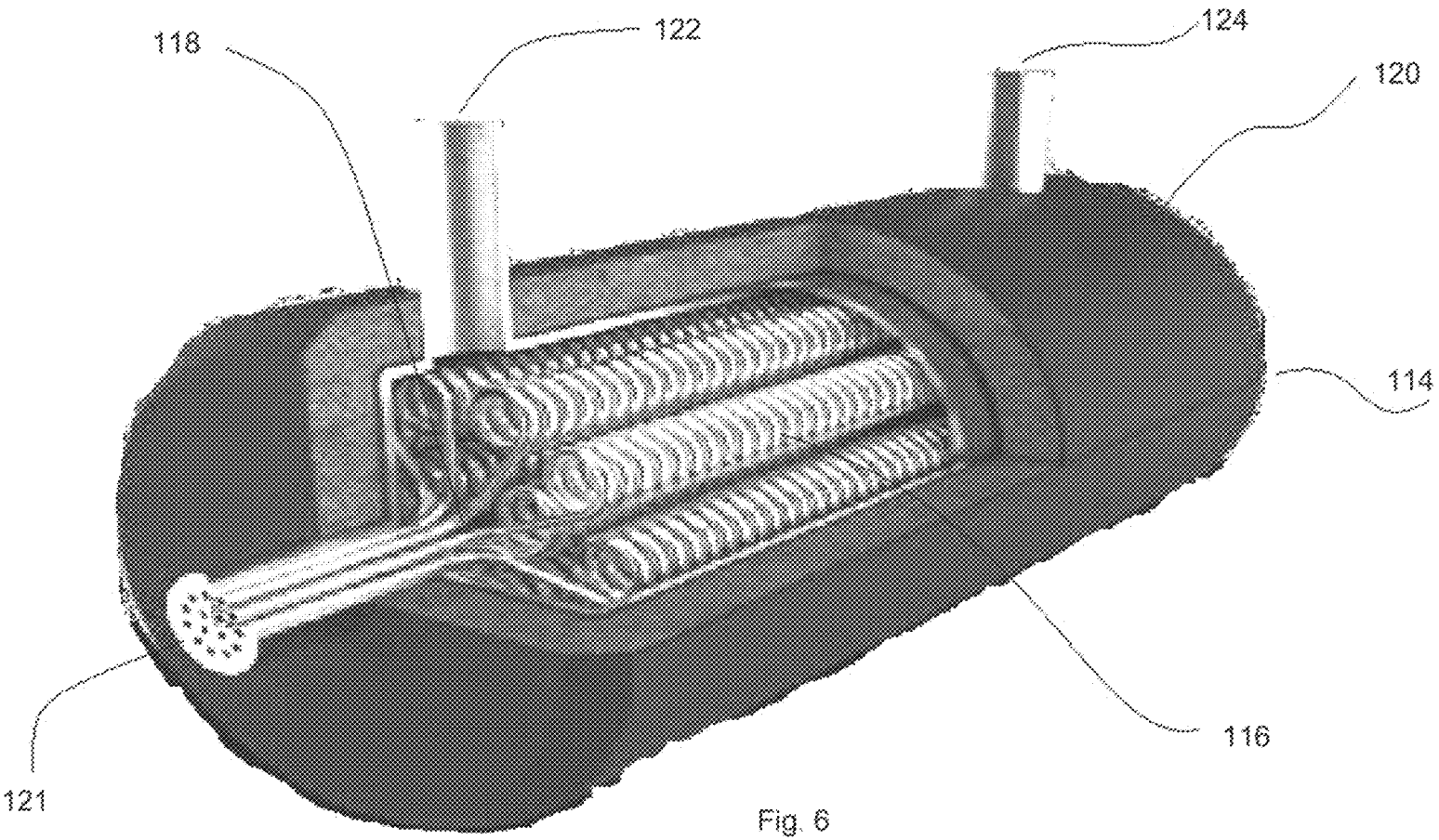
FIG. 6 illustrates a top, front, side perspective view of a heat exchanger of the refrigeration system of FIG. 4.

Referring to FIG. 6, evaporator 101 may be of a design other than a plate heat exchanger. Evaporator 101, for example, is a cylindrical heat exchanger 114 that has a series of helical refrigerant coils 116, terminated with a common inlet and outlet manifold 118 having a manifold inlet 121 and a manifold outlet (not shown) at opposite ends of inlet and outlet manifold 118, contained within a thermally-insulated fabricated metal can 120. The metal can 120 may have an inlet port 122 and outlet port 124 at opposite ends, through which a second cooling medium, such as propylene glycol solution, might be pumped, passing over and around the refrigerant coils.

Referring back to FIG. 5, the second cooling medium may be an anti-freeze liquid coolant solution that is circulated through a secondary system 125 through evaporator 101 via pump 11, where the second cooling medium is cooled. The second cooling medium continuously circulates through pump 11 positioned in refrigeration module 1 to heat exchanger coil 6 positioned in beverage cooling module 3 and back to pump 11 positioned in refrigeration module 1. The second cooling medium is cooled to a suitable temperature for the beverage cooling application that is generally a temperature below 0 degrees Celsius, where it is possible to cause a layer of ice, known to the industry as an icebank, to form on heat exchanger coil 6 in tank 5.

The second cooling medium is continuously recirculated until a predetermined temperature in tank 5 has been reached, or a predetermined amount of ice (the icebank) has formed on heat exchanger coil 6. The predetermined temperature, or predetermined amount of ice in tank 5, is measured by a temperature or resistance sensor (not shown) fixed in tank 5, which signals both refrigeration system 112 and pump 11 to operate or switch off by a controller, dependent upon the predetermined temperature, or predetermined amount of ice in tank 5 measured by the temperature or resistance sensor.

Pump 11 and fan 12 are connected to dual spindle motor 13 to drive both pump 11 and fan 12. The benefits of using dual spindle motor 13 include: 1. reduced component count; 2. reduction of the space required in refrigeration module 1; 3. increased reliability (fewer components to fail); 4. reduced assembly time; 5. improved serviceability; 6. reduced electrical wiring complexity; and 7. potential reduction in energy consumption. Alternatively, pump 11 and fan 12 would normally be powered by separate motors. In this instance, a single motor 13 is employed to operate both system elements.

Alternative arrangements of motors for pump 11 and cooling fan 12 include separate induction-type motors. The benefits of separate induction-type motors include low cost, and mass produced for a wide selection of choices available.

Another alternative arrangement of motors for pump 11 and cooling fan 12 includes separate electronically commutated motors. The benefits are separate electronically commutated motors include high reliability, low energy consumption, low heat output, the ability to control a shaft rotation speed of the motors to optimize performance for prevailing operating conditions, and low lifetime costs.

Still another alternative arrangement of motors for pump 11 and cooling fan 12 includes a dual spindle induction motor. The benefits of the dual spindle induction motor are use of a single motor to drive two separate components, compact system—space saving, relatively low cost, reduced spare parts requirement.

Still another alternative arrangement of motors for pump 11 and cooling fan 12 includes dual spindle electronically commutated motor. The benefits of the dual spindle electronically commutated motor include use of a single motor to drive two separate components, compact system—space saving, high reliability, low energy consumption, low heat output, ability to control a shaft rotation speed of the motor to optimize performance for prevailing operating conditions, reduced spare parts requirement, and low lifetime costs.

Figure 7:
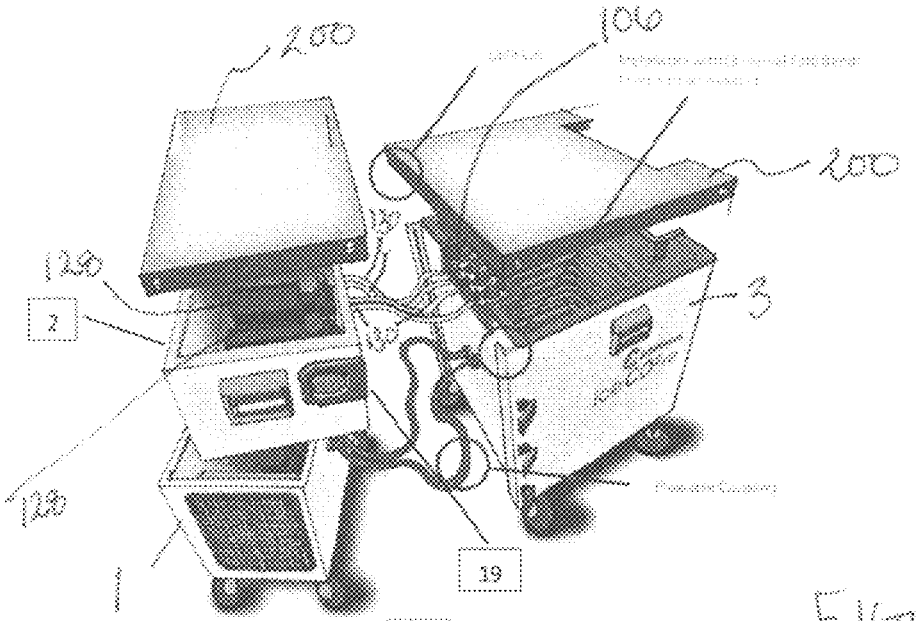
FIG. 7 illustrates a partially exploded top, front, side perspective view of the beverage cooling system of FIG. 1.
Figure 7A:
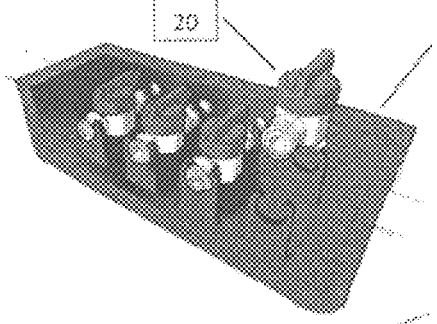
FIG. 7A illustrates a partially exploded top, front, side perspective view of quick-release push-in style tubing couplers.

Referring to FIG. 7, pumping and control module 2 contains pumps 128. Pumps 128 pump beverage ingredients from one or more sources to beverage cooling module 3 through pump tubing 130 that connects to valves 106. The beverage ingredients are both carbonated and un-carbonated liquids, which may include potable water or alcoholic beverages, from an external source. From beverage cooling module 3, carbonated or un-carbonated liquid, which may include water, may be transported to a beverage dispensing head (not shown) through a flow line known to the industry as a python (not shown), where beverage may be dispensed on demand. The python may be retained cool by the constant circulation of a cooling medium, which may be water, utilizing pumping and control module 2 and beverage cooling module 3, cooling coils 4, or cooling medium taken directly from cooling tank 5, by utilizing a semi-submersible pump/agitator (not shown) sited in beverage cooling module 3.

Pumping and control module 2 also contains a programmable electronic controller 19 and a circuit board which may include, among other features, such features as intelligent diagnostics, energy management, telemetry, remote diagnostics, asset tracking and an operator interface screen.

Referring to FIG. 7A, pumping and control module 2 is designed so that it may be de-pressurized and quickly and easily disconnected from the other modules in the system, using quick-release push-in style tubing couplers 20, similar to valves 106, wherever possible.

Figure 8:
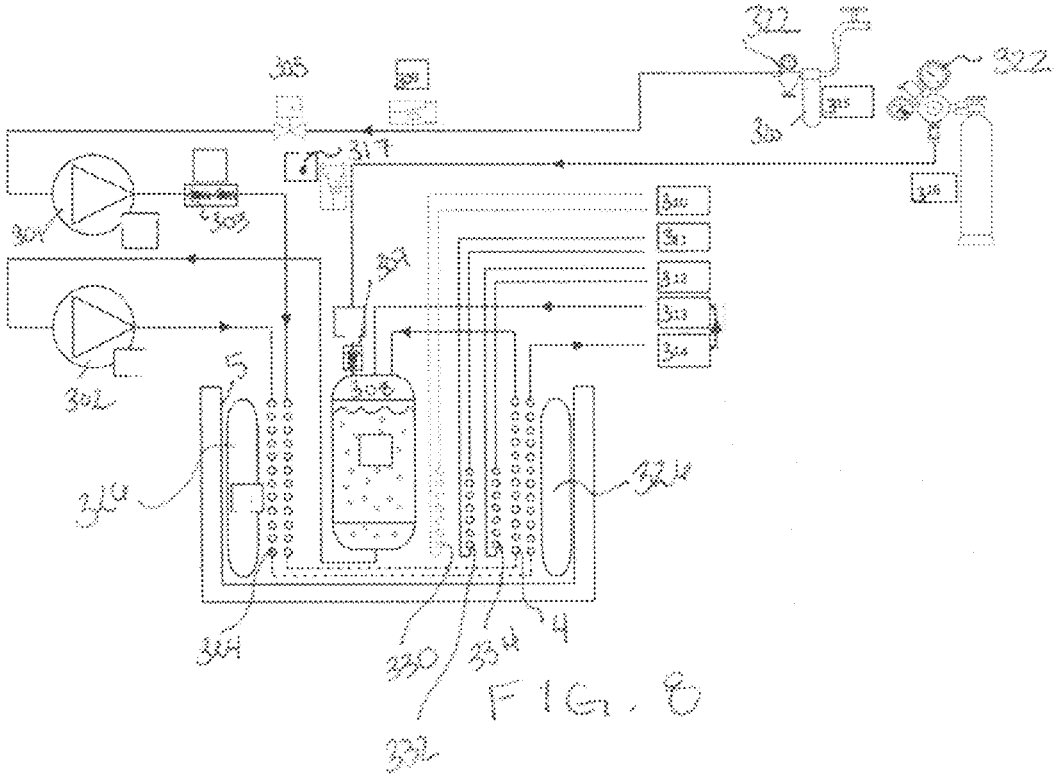
FIG. 8 is a schematic diagram of a carbonation system of the beverage cooling system of FIG. 1.

Referring to FIG. 8, a schematic diagram of a carbonation system of beverage cooling system 10 includes a water supply 315 that supplies water through a flood solenoid 305 and a low water pressure switch 309 that is optional. Water supply 315 may include a filter 320 and water regulator 322. Water flows from flood solenoid 305 to a carbonator pump 301 that pumps water through a double non-return valve 303 to cooling coils, for example, cooling coils 4 in tank 5 of beverage cooling module 3 having an ice bank 326, into carbonator bowl 308 that creates carbonated water. Carbonator bowl 308 receives a flow of carbon dioxide from carbon dioxide bottle 316 that flows through a carbon dioxide regulator 317 and a single non-return valve 307. The carbonated water flows from carbonator bowl 308 to a soda recirculation pump 302. Soda recirculation pump 302 pumps the carbonated water to another set of cooling coils 324 in tank 5 of beverage cooling module 3 that connects the carbonated water to python 314. A portion of the carbonated water circulates from python 314 to a beverage dispenser (not shown) and a portion of the carbonated water circulates from python 314 to a soda recirculation return 313 that flows the carbonated water back to carbonator bowl 308. A pre-mix beverage may be circulated from a pre-mix source 310 through pre-mix cooling coils 330 in tank 5 of beverage cooling module 3 to cool the pre-mix beverage prior to dispense. Syrup may be circulated from a syrup source 311 through syrup cooling coils 332 in tank 5 of beverage cooling module 3 for cooling the syrup prior to mixing with still water or carbonated water to form a beverage to dispense. Still water may be circulated from a still water source 312 through still water cooling coils 334 in tank 5 of beverage cooling module 3 to cool the still water prior to mixing with syrup to form a beverage for dispense. Pre-mix cooling coils 330, syrup cooling coils 332 and still water cooling coils 334 may connect to python 314 or directly to the beverage dispenser for dispense.

Figure 9:
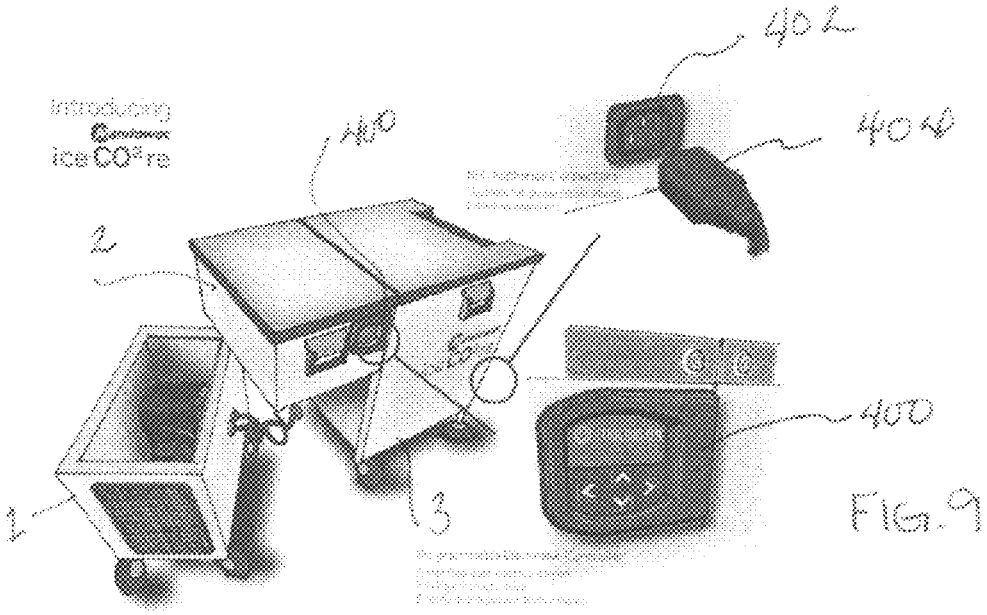
FIG. 9 illustrates a partially exploded top, front, side perspective view of the beverage cooling system of FIG. 1.

Referring to FIG. 9, beverage cooling module 3 may have an outlet 402 that connects to a cord 404 to connect to a power source. Pumping and control module 2 may have a user interface 400 for input to and output from a controller of beverage cooling system 10 for operation of beverage cooling system 10.

Figure 11:
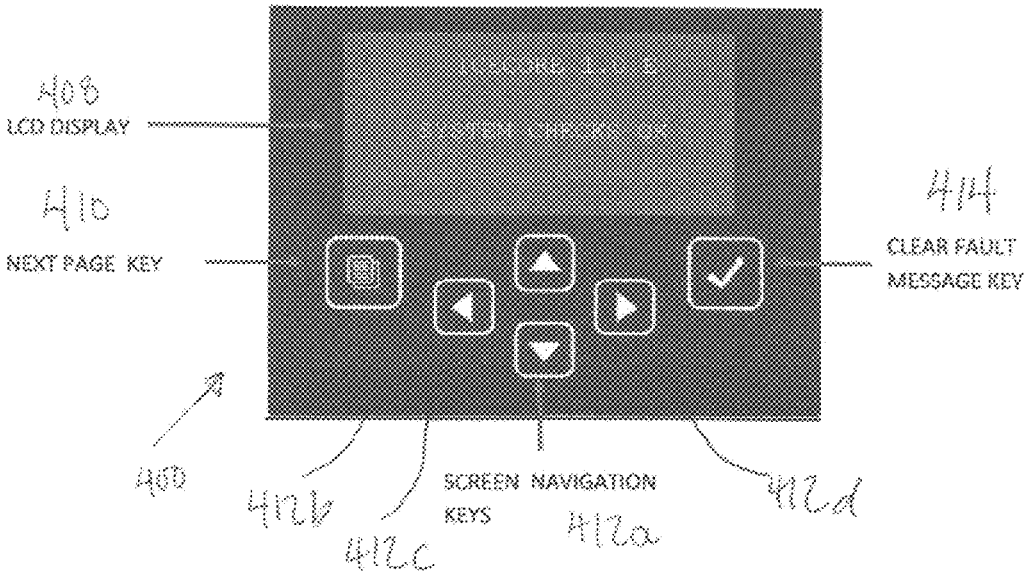
FIG. 11 illustrates a front view of a user interface of the beverage cooling system of FIG. 1 showing the home page.
Figure 12:
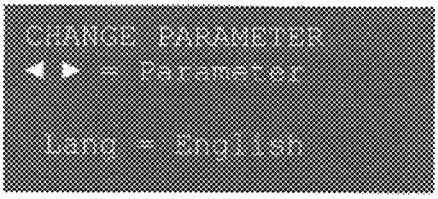
FIG. 12 illustrates a front view of a liquid crystal display of the user interface of FIG. 11 showing a set language screens.

Referring to FIG. 11, an example of user interface 400 is shown. User interface 400 has a liquid crystal display 408 and buttons 410, 412*a*, 412*b*, 412*c*, 412*d*, and 414. Liquid crystal display 408 is showing a home page in FIG. 11. Button 410 is a next page button. Buttons 412*a*, 412*b*, 412*c*, 412*d* are arrow buttons. Button 141 is a clear fault message key button. When beverage cooling system 10 is powered up, or turned on, if all switchable outputs have been set to off, which may be done during production, user interface 400 will display a change language parameter screen on liquid crystal display 408, as shown by FIG. 12. A user may change the language of user interface 400 by pressing buttons 412*b* and 412*d*. English may be the default language that may be changed to French or German. The user is allowed a predetermined time, for example, 60 seconds, to select a language. If unchanged after 60 seconds, then the language previously stored in a memory of the controller, or the default language, is retained. When a setting change is made this is (i.e. language change or an output switched on/off), the change will happen instantaneously and the status is saved in the working memory (RAM). However, this change is not saved in the non volatile memory until returned back to the home page. This means that if a setting change is made and there is a power down before returning to the home page the setting change will not be saved on power up. Settings are automatically saved when controller returns user interface to the home page.

Figure 13:
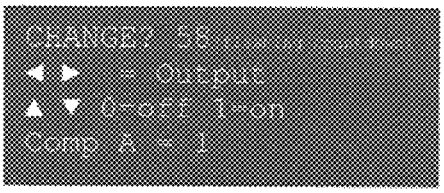
FIG. 13 illustrates a front view of a liquid crystal display of the user interface of FIG. 11 showing set output screens.
Figure 13:
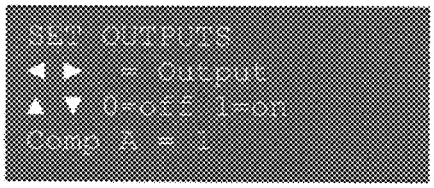

Button 410 is used to navigate to a set outputs screen shown in FIG. 13. On power up, the set outputs screen will be the first screen to display on user interface 400 if any of the switchable outputs are set to "On". If all switchable outputs are set to "Off" the set language parameter shown in FIG. 12 will be first to display. All switchable outputs are temporarily suspended to "off" and a countdown, for example, 60 seconds, will start. The top line shown on liquid crystal display 408 flashes "CHANGE xx". During the countdown the displayed status of the outputs will not change even though power to the component is suspended, until, the countdown ends. If any changes commence, by pressing buttons 412*b* and 412*d*, the count will go on hold until a page shown on liquid crystal display 408 is exited or no buttons have been pressed for a predetermined amount of time, for example, 3 minutes. Once the countdown is completed, the power will resume to the components of refrigeration module 1, pumping and control module 2, and beverage cooling module 3 previously set to "on" before the power down. The purpose of this function is to allow the technician time to switch components off in the menu. For example, to prevent the carbonator pump immediately switching "On", when powered up, if a pipe is disconnected or supply water off. If power is uninterrupted, the set outputs screen may be reached by navigating menu, then there the countdown will not be activated, there will not be a temporary suspension of power to the components, and an "On/Off" status of components will remain unchanged. The set outputs screen allows the user to switch on /off carbonator pump 301, soda recirculation pump 302 and compressor 8. There may be more than one carbonator pump 301, soda recirculation pump 302 and compressor 8, which may be controlled by the set outputs screen only if this parameter is switched on in a menu of the controller. Buttons 412*b* and 412*d* are used to choose which outputs to set and buttons 412*a* and 412*c* are used to switch the selected output on or off. If after a predetermined time, for example, 3 minutes, no changes has been made, settings will default to a status when beverage cooling system 10 was last powered down and user interface 400 will display the home page. The user may navigate user interface 400 to display the home page by pressing next page key 410.

Figure 14:
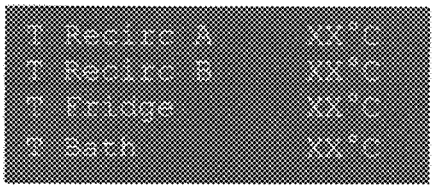
FIG. 14 illustrates a front view of the liquid crystal display of the user interface of FIG. 11 showing a temperature display screen.
Figure 16:
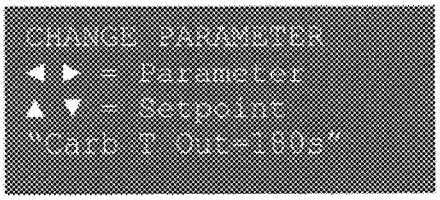
FIG. 16 illustrates a front view of the liquid crystal display of the user interface of FIG. 11 showing a change parameters screen.

Referring back to FIG. 11, the home page will be reached by timing out of any other of the pages displayed on liquid crystal display 408 or scrolling through menu screens that include: the home page, a temperature display screen shown in FIG. 14, status page 1 shown in FIG. 15, status page 2 shown in FIG. 15, status page 3 shown in FIG. 15, a change parameters menu screen shown in FIG. 16, and a set outputs screen shown in FIG. 13. Next page key 410 is pressed to navigate from the home page to the temperature display screen that displays the temperature of recirculating soda water, the first cooling medium, the second cooling medium and cooling medium in tank 5. If there is another recirculating soda loop, then this temperature will only be displayed if this parameter is switched on in the parameters menu. There is no input by the user in the temperature display screen. If no buttons are pressed for a predetermined amount of time, for example, 3 minutes, user interface 400 will display the home screen.

Next page key 410 is pressed to navigate from the temperature display screen to the status page 1 screen, status page 2 screen and status page 3 screen shown in FIG. 15, that indicate an actual operational status of the main components of refrigeration module 1, pumping and control module 2, and beverage cooling module 3. Status page 1 screen, status page 2 screen and status page 3 screen will not indicate to the user if a component has failed, however, indication of whether power is received from a board is indicated. A B components pack on status page 3 will only display in this menu if switched "on" in the parameters menu. There is no input by the user in the status page 1 screen, status page 2 screen and status page 3 screen. If no buttons are pressed for a predetermined amount of time, for example, 3 minutes, user interface 400 will display the home screen.

Figure 17:
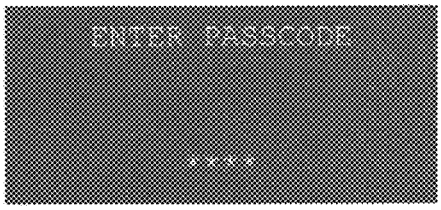
FIG. 17 illustrates a front view of the liquid crystal display of the user interface of FIG. 11 showing a enter password screen.
Figure 18:
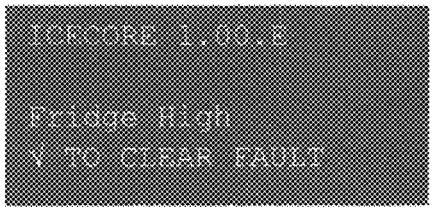
FIG. 18 illustrates a front view of the liquid crystal display of the user interface of FIG. 11 showing the home page screen with a fault.

Next page key 410 is pressed to navigate from status page 1 screen, status page 2 screen and status page 3 screen to the change parameter screen shown in FIG. 16 that allows the user to change or view parameters of beverage cooling system 10. The change parameter screen may be password protected, and a password must be entered into a enter password screen, shown in FIG. 17, to change the parameters. Table 1 shows the parameters that may be changed.

TABLE 1

| PARAMETER OPTIONS | PARAMETER VALUE RANGE |
|---|---|
| Lang = French | Default = English Option: English, French, German |
| Recirculation H. RECIRC = 4 C. | Default = 4° C. Adjustable between 4-10° C. (1° C. steps) |
| Refrigeration system FRIDGE HIGH = 65 C. | Default = 65° C. Adjustable between 60-68° C. (1° C. steps) |
| CLEAN COND = 55 C. | Default = 55° C. Adjustable between 50° C. up to "FRIDGE HIGH" parameter value (1° C. steps). |
| HIGH BATH = 3 C. | Default = 3° C. Adjustable between 3-10° C. (1° C. steps) |
| CARB T OUT = 180 s (Value sets both A & B Circuits) | Default = 180 sec. Adjustable between 90-300 sec. (10 sec. steps) |
| COMPONENTS B = 0 Switches components pack B on/off | Default = 0 (i.e. Off = 0 On = 1) Components pack B Carb pump B |

TABLE 1-continued

| PARAMETER OPTIONS | PARAMETER VALUE RANGE |
|---|---|
| When set to "off" B components will be removed from: Set Outputs Menu Temperature Display & Status Pages | Recirc. pump B Compressor B |
| Reset R744 = 1 | Default = 1 (on) Allows technician to reset R744 over pressure cut out after fault has been rectified. |

The user presses buttons 412*b* and 412*d* to choose a parameter and buttons 412*a* and 412*c* to change values of the parameter. When buttons 412*a* and 412*c* are pressed the enter password screen is displayed. Once the password is entered, all parameters values can be changed until the change parameter screen is exited. A predetermined amount of time, for example, one minute, is allowed for password entry of the change parameters screen will automatically be displayed. If no buttons are pressed for a predetermined amount of time, for example, 3 minutes, user interface 400 will display the home screen.

Next page key 410 is pressed to navigate from the change parameter screen to the set outputs screen shown in FIG. 13 that allows the user to switch carbonator pump 301, soda recirculation pump 302 and compressor 8 on and off. Additional carbonator pump 301, soda recirculation pump 302 and compressor 8 may be included in beverage cooling system 10 that will only display in the outputs screen if switched on in the parameters menu. Buttons 412*b* and 412*d* choose which outputs of carbonator pump 301, soda recirculation pump 302 and compressor 8 to set and buttons 412*a* and 412*c* switch carbonator pump 301, soda recirculation pump 302 and compressor 8 on and off. These settings are automatically saved when the home page is navigated to or next page key 410 is pressed to navigate to the home page.

The home page shows faults as shown in FIG. 19. Examples of faults are shown in the Fault Diagnosis Table, Table 2.

TABLE 2

| Message Displayed | Input Sensor (some inputs have more than one sensor options) | Default Set Point | Adjustable range and increments (where applicable) | PCB Action(s) | Self/ Manual reset |
|---|---|---|---|---|---|
| High Recirc A | TRCR A | +4° C. and above for more than 1 minute | +4° C. to +10° C. 1° C. steps | Flash message and temperature | Self Reset |
| High Recirc B | TRCR B | +4° C. and above for more than 1 minute | +4° C. to +10° C. 1° C. steps | Flash message and temperature | Self Reset |
| Clean Condenser N/A for R744 units | T REF (Was T LINE A) | +55° C. and above for a period of 20 minutes | +50° C. to "Fridge High" Set-point 1° C. steps | Flash message and temperature | Self Reset |
| Fridge High (over temp) N/A for R744 units | T REF (Was T LINE A) | +65° C. and above for a period of 15 minutes | +60° C. to +65° C. 1° C. steps | Flash message and temperature Switch off compressors A & B | Manual Reset |
| Over Ice | T BATH (Was T LINE B) | −1° C. and above for a period of 30 minutes | Non Adjustable | Flash message and temperature Switch off compressor | Manual Reset |
| High Bath Temp XX deg C. | T BATH (Was T LINE B) | +3° C. and above for a period of 10 mins | Non Adjustable | Flash message and temperature | Self Reset |

TABLE 2-continued

| Message Displayed | Input Sensor (some inputs have more than one sensor options) | Default Set Point | Adjustable range and increments (where applicable) | PCB Action(s) | Self/ Manual reset |
|---|---|---|---|---|---|
| Low Co2 Press | LOW CO2 (230 v) | Switch contacts N/O if Co2 pressure high (OK) (230 V) | Switching Pressure dependant on pressure switch set point | Flash message Switch off: Carb pump A Switch off: Recirc pump A Switch off: Carb pump B Switch off: Recirc pump B | Manual Reset |
| | CO2PSEN (5 v) | Below x.x psi for a period of 10 seconds | Non Adjustable | | |
| | CO2SW (5 v) | Switch contacts N/O if Co2 pressure high (OK) (5 v) | Switching Pressure dependant on pressure switch set point | | |
| Low Water Press | WATER | Switch contacts N/O if water pressure high (OK) (230 V) | Switching Pressure dependant on pressure switch set point | Flash message Switch off: Carb pump A Switch off: Recirc pump A Switch off: Carb pump B Switch off: Recirc pump B | Manual Reset |
| | H2OPSEN | Below x.x psi for a period of 10 seconds | Non Adjustable | | |
| High Refr. Press Call Technician Note: fault to alternate between the two meassages on the third line. (Note: R744 units only) | HPCO2 | Switch contacts normally closed if Fridge pressure OK, opens on high pressure fault | Switching Pressure dependant on pressure switch set point (140 bar C/Out 100 bar C/In) | Flash message Switch off: Compressor A & B Switch off pumps carb and recirc | Manual Reset (only in parameters) Call Technician |
| Carb. A Time Out | N/A time based | Default = 180 sec. | 60 to 300 sec. (10 sec. steps) | Flash message Switch off: Carb pump A Switch off: Recirc pump A | Manual Reset |
| Carb. B Time Out | N/A time based | Default = 180 sec. | 60 to 300 sec. (10 sec. steps) | Flash message Switch off: Carb pump B Switch off: Recirc pump B | Manual Reset |
| Comp. A Time Out | N/A time based | Continious running for 12 hours | Non Adjustable | Flash message Switch off: Compressor A | Manual Reset |
| Comp. B Time Out | N/A time based | Continious running for 12 hours | Non Adjustable | Flash message Switch off: Compressor B | Manual Reset |
| Carb. A Overtemp | THCOA Note: check swich OK for this 5 v, 1 ma input | Switch contacts normally closed if OK Open on fault condition | Non Adjustable depanant on thermal sw. setting | Flash message Switch off: Carb pump A Switch off: Recirc pump A | Manual Reset |
| Carb. B Overtemp | THCOB Note: check swich OK for this 5v, 1 ma input | Switch contacts normally closed if OK Open on fault condition | Non Adjustable depanant on thermal sw. setting | Flash message Switch off: Carb pump B Switch off: Recirc pump B | Manual Reset |

"To clear fault" will only be displayed if the fault can be reset by the user.

Figure 10:
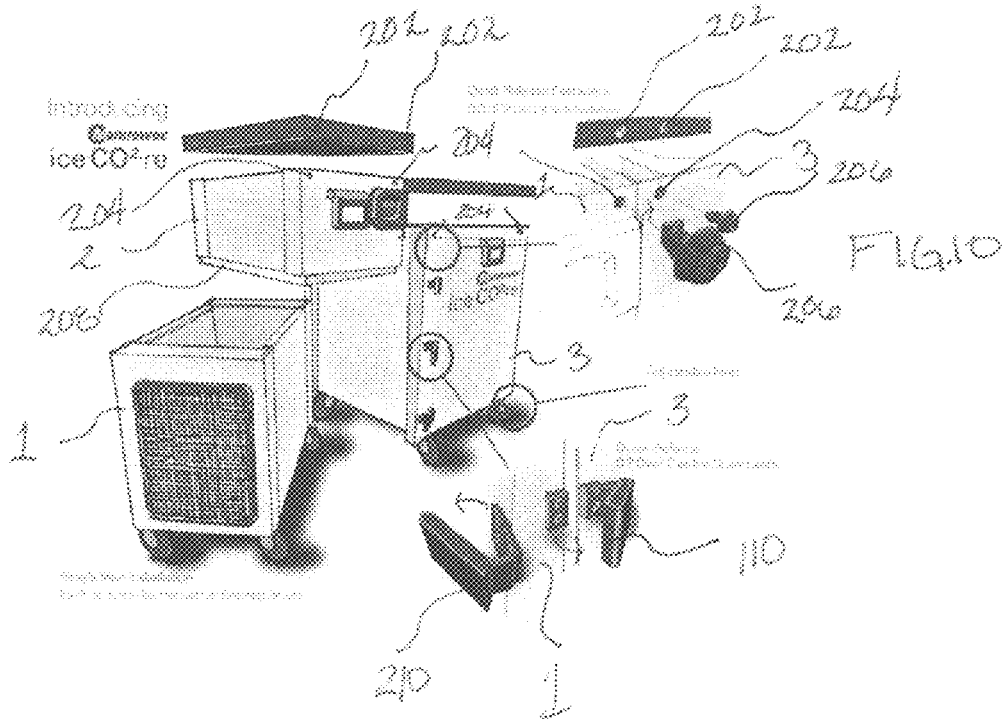
FIG. 10 illustrates a partially exploded top, front, side perspective view of the beverage cooling system of FIG. 1.

Referring to FIG. 10, lids 200 have lid apertures 202 and pumping and control module 2 and beverage cooling module 3 have module apertures 204. Lid apertures 202 are aligned with module apertures 204 when lids 200 are in place on pumping and control module 2 and beverage cooling module 3, respectively, so that lid apertures 202 and module apertures 204 receive fasteners 206. Fasteners 206, lid apertures 202 and module apertures 204 may each be shaped so that fasteners 206 fit through lid apertures 202 and module apertures 204 in a first position, and, when fasteners 206 are rotated 90 degrees, fasteners 206 do not fit through lid apertures 202 and module apertures 204 to secure lids 200 on pumping and control module 2 and beverage cooling module 3. Pumping and control module 2 may have a depression 208 that fits in refrigeration module 1 so that pumping and control module 2 may be stacked on refrigeration module 1 to provide a cover for refrigeration module 1. Beverage cooling module 3 has latches 110 that mate with mating latches 210 on each of refrigeration module 1 and pumping and control module 2 to secure refrigeration module 1, pumping and control module 2 and beverage cooling module 3 together.

In operation, as shown in FIGS. 3 and 4, refrigeration module 1 has refrigeration system 112 that cools evaporator 101. Evaporator 101 is positioned in refrigeration module 1 that cools the second cooling medium that circulates through coolant transfer tubing 14 into heat exchanger coil 6 positioned in tank 5 of beverage cooling module 3. As shown in FIG. 7, the beverage ingredients are pumped from a beverage ingredient source through pumps 128 to valves 106 on beverage cooling module 3 into cooling coils 4. As shown in FIG. 2, cooling coils 4 are immersed in tank 5 filled with the cooling medium that is cooled by heat exchanger coil 6 to cool the beverage ingredients for dispense.

A reduction may be possible in beverage cooling system 10 in a weight of refrigerant used to charge refrigeration system 112, whilst maintaining the cooling output of a similar sized conventional design. In the case of the hydrocarbon refrigerant R290 (Propane), a charge limit of 150 grams is set on all refrigerating equipment in the classification "Category A Occupancies". Beverage cooling system 10 can fall into this category, and as such is restricted to a maximum refrigerant charge of 150 grams.

There is a limiting effect on the size and cooling capacity of a conventional beverage cooler that may be designed for use with R290 refrigerant. However, replacing a conventional copper tube evaporator with a heat exchanger evaporator with heat exchanger coil 6, and compressor 8 that can be a low-volume condenser replacing the conventional condenser, a charge reduction of more than 30% (by weight) may be achieved for a similar overall cooling performance.

The size and cooling capacity of existing beverage coolers, using R290 refrigerant with a conventional evaporator and condenser, is limited to a compressor size of typically 15 cc displacement, due to the restriction on refrigerant charge weight. This gives a typical average useful cooling duty of approximately 900 watts during the icebank-building, or "recovery" phase of the refrigerant cycle.

Whereas conventional beverage coolers using R290 refrigerant are limited by the 150 grams refrigerant charge weight to a maximum compressor size of typically 15 cc displacement, the use of the heat exchanger evaporator with heat exchanger coil 6, and compressor 8 that can be a low-volume condenser (which may, for example, be a gas cooler of the type used in an R744 [CO2] refrigerant system) may permit an increase in the maximum size and capacity of an R290 beverage cooler. The larger capacity cooler might contain a compressor, for example, compressor 8, of typically up to 21 cc displacement, with a useful cooling capacity in excess of 1,200 watts, whilst remaining within the "Category A Occupancies" classification. Thus, maximum cooling capacity may be increased by typically 30% over equivalent conventional designs, whilst remaining within the 150 grams refrigerant charge limit.

In beverage cooling system 10, the conventional evaporator is replaced with a liquid heat exchanger with heat exchanger coil 6, which may be a copper or stainless steel coil, through which passes, for example, a solution of chilled anti-freeze, which may be a solution of propylene glycol. As refrigerant is no longer transported through the system into the waterbath evaporator, it is not necessary to connect the fridge compartment and waterbath with rigid semi-permanent or permanently jointed metal tubing. The transport tubing for the anti-freeze, for example, coolant transfer tubing 14, may be flexible plastic tubing, and the joints, for example, valves 106, may be of a quick-release type, for example the "John Guest Speedfit®" design. The addition of plastic isolating valves, for example, valves 106, allows the waterbath-based heat exchanger with heat exchanger coil 6 to be isolated from the supply system, thereby permitting the waterbath in tank 5 and refrigeration module 1 to be quickly and easily separated. Refrigeration module 1 can be removed and replaced using one trained operative, who is not necessarily skilled in the art of refrigeration. This may be done independently of the rest of beverage cooling system 10, minimizing the cost of the service call and replacement parts, and the downtime and loss of sales incurred by the end user.

Beverage cooling system 10 has the advantage that a single service operative may quickly and easily replace refrigeration module 1 for one more appropriate to the demand, with no downtime to the end user whatsoever. Likewise, beverage cooling module 3 also be easily exchanged for one with a greater or smaller capacity icebank, with minimal downtime, by a single service operative.

Beverage cooling system 10 permits a change in refrigerant to be accommodated with virtually no disruption to the end user, and at minimal service cost. Refrigeration module 1 may be disconnected from the remainder of beverage cooling system 10, and a replacement for refrigeration module 1 containing the new refrigerant may simply be connected, by a single service operative, to the remainder of beverage cooling system 10 via the quick release/connect fittings, without the need to exchange complete coolers or melt-back and re-produce icebanks.

Beverage cooling system 10 may allow refrigeration module 1 to be disconnected and sited remotely from the remainder of beverage cooling system 10, in an area more suited to its requirements for optimum performance. Flexible insulated tubes would transport the secondary coolant to and from beverage cooling module 3, with electrical extension wires providing a link to refrigeration controls and power source.

Beverage cooling system 10 allows just the failed module of refrigeration module 1, pumping and control module 2, and beverage cooling module 3 to be removed from the remainder of the main assembly of beverage cooling system 10 and returned, thus saving a substantial amount of factory space, or permitting a higher volume of parts awaiting repair to be stored in the available space.

The present invention having been thus described with particular reference to the preferred forms thereof, it will be obvious that various changes and modifications may be made therein without departing from the spirit and scope of the present invention as defined in the appended claims.

We claim:

1. A beverage cooling system comprising: a main assembly having a refrigeration module with a fan, a pumping and control module, and a beverage cooling module, the refrigeration module having a refrigeration system cooling a cooling medium, the beverage cooling module having a cooling tank cooled by the refrigeration system, and the pumping and control module having a pump to pump a beverage ingredient cooled by the refrigeration system, wherein each of the refrigeration module, the pumping and control module, and beverage cooling module are independently removable from and connectable to the remainder of the main assembly, and wherein the pump and the fan are operated by the same motor.

2. The beverage cooling system of claim 1, wherein the refrigeration module, the pumping and control module, and the beverage cooling module form a complete beverage cooling system.

3. The beverage cooling system of claim 1, wherein the cooling medium of the refrigeration system is a first cooling medium, wherein the beverage cooling module has a heat exchanger coil in the cooling tank that is filled with a second cooling medium and cooling coils in the cooling tank in which the beverage ingredient flows through the cooling coils.

4. The beverage cooling system of claim 1, wherein the beverage ingredient flows from a source external from the beverage cooling system to the beverage cooling module that is transported to a beverage dispenser by the pumping and control module.

5. The beverage cooling system of claim 1, wherein the refrigeration module has a compressor, a condenser or gas cooler, an evaporator or heat exchanger, a transfer tubing, and rigid copper refrigeration tubing, that are housed in a refrigeration housing.

6. The beverage cooling system of claim 5, wherein the heat exchanger is a plate heat exchanger or a heat exchanger that includes a plurality of helical refrigerant coils.

7. The beverage cooling system of claim 1, wherein the refrigeration module is located remotely from the pumping and control module and the beverage cooling module.

8. A beverage cooling system comprising: a refrigeration module with a fan having a refrigeration system cooling a first cooling medium; and a beverage cooling module connected to the refrigeration module, the beverage cooling module having a cooling tank that cools at least one beverage ingredient, and the beverage cooling module having a second cooling medium cooled by the refrigeration system that is circulated in the cooling tank via a pump, and said cooling tank being filled with another cooling medium, the another cooling medium being cooled by the second cooling medium that flows between the refrigeration module and the beverage cooling module, wherein the pump and the fan being operated by the same motor.

9. The beverage cooling system of claim 8, wherein the refrigeration module has an evaporator or heat exchanger, and wherein the first cooling medium and the second cooling medium are both circulated through the evaporator or heat exchanger.

10. The beverage cooling system of claim 9, wherein the evaporator or heat exchanger is positioned in the refrigeration module so that the first cooling medium circulates in the refrigeration module only.

11. The beverage cooling system of claim 9, wherein the second cooling medium circulates through the evaporator or heat exchanger in the refrigeration module and the cooling tank of the beverage cooling module.

12. The beverage cooling system of claim 9, wherein the second cooling medium is circulated through the evaporator or heat exchanger by the pump.

13. The beverage cooling system of claim 12, wherein the first cooling medium flows into a condenser or gas cooler where the first cooling medium is cooled by the fan.

14. The beverage cooling system of claim 8, wherein the second cooling medium circulates through flexible tubing in the refrigeration module and the beverage cooling module.

15. The beverage cooling system of claim 8, wherein the second cooling medium is a stable liquid selected from the group consisting of glycol, glycol/water mixture, and combination thereof.

16. A beverage cooling system comprising: a refrigeration system cooling a first cooling medium, the first cooling medium flowing into a condenser or gas cooler where the first cooling medium is cooled by a fan; and a second cooling medium cooled by the refrigeration system that is circulated by a pump in a cooling tank to cool at least one beverage ingredient, the pump and the fan being operated by the same motor.

17. The beverage cooling system of claim 16, wherein the motor is a dual spindle induction motor.

18. The beverage cooling system of claim 16, wherein the motor is a dual spindle electronically commutated motor.

* * * * *